US010072229B2

(12) United States Patent
Lostak et al.

(10) Patent No.: US 10,072,229 B2
(45) Date of Patent: Sep. 11, 2018

(54) USE OF A SULPHATE, AND METHOD FOR PRODUCING A STEEL COMPONENT BY FORMING IN A FORMING MACHINE

(71) Applicants: ThyssenKrupp Steel Europe AG, Duisburg (DE); ThyssenKrupp AG, Essen (DE)

(72) Inventors: Thomas Lostak, Neukirchen-Vluyn (DE); Christian Timma, Duisburg (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/509,524

(22) PCT Filed: Aug. 19, 2015

(86) PCT No.: PCT/EP2015/069018
§ 371 (c)(1),
(2) Date: Mar. 8, 2017

(87) PCT Pub. No.: WO2016/037814
PCT Pub. Date: Mar. 17, 2016

(65) Prior Publication Data

US 2017/0260471 A1 Sep. 14, 2017

(30) Foreign Application Priority Data

Sep. 11, 2014 (EP) ..... 14184415

(51) Int. Cl.
*F16C 33/12* (2006.01)
*C10M 103/06* (2006.01)
(Continued)

(52) U.S. Cl.
CPC ..... *C10M 103/06* (2013.01); *C10M 103/00* (2013.01); *C10M 173/02* (2013.01);
(Continued)

(58) Field of Classification Search
CPC ..... C10M 2201/084; C10N 2230/12; C10N 2250/121; C10N 2240/404
(Continued)

(56) References Cited

U.S. PATENT DOCUMENTS 4,168,241 A 9/1979 Kozima et al.
6,194,357 B1 2/2001 Murata et al.
(Continued)

FOREIGN PATENT DOCUMENTS

DE 10007625 A 8/2001
DE 10007625 A1 8/2001
(Continued)

OTHER PUBLICATIONS

Int'l Search Report for PCT/EP2015/069018 dated Oct. 8, 2015 (dated Oct. 16, 2015).
(Continued)

*Primary Examiner* — Vishal Vasisth
(74) *Attorney, Agent, or Firm* — Lathrop Gage L.L.P.

(57) ABSTRACT

Coating materials with minimized lubricant demand enable optimized tribological conditions in forming flat steel products and are also unobjectionable in relation to their effects on the environment. With such coating materials, steel components can be produced by forming flat steel products in forming machines. For example, a tribologically-active layer may be produced on at least one surface of a flat steel product or a forming machine used to form the flat steel product, wherein the at least one surface comes into contact with the opposing component during forming. The tribologically-active layer may be formed by coating the at least
(Continued)

one surface with a coating material from a group consisting of aluminum sulfate, ammonium sulfate, iron sulfate, and magnesium sulfate. The flat steel product may be inserted into the forming machine to be formed into the steel component.

15 Claims, 2 Drawing Sheets

(51) Int. Cl.
*C10M 173/02* (2006.01)
*C10M 103/00* (2006.01)
*C23C 22/53* (2006.01)

(52) U.S. Cl.
CPC ..... *C23C 22/53* (2013.01); *C10M 2201/084* (2013.01); *C10N 2230/06* (2013.01); *C10N 2230/12* (2013.01); *C10N 2240/40* (2013.01); *C10N 2240/404* (2013.01); *C10N 2240/405* (2013.01); *C10N 2240/408* (2013.01); *C10N 2250/121* (2013.01)

(58) Field of Classification Search
USPC ..... 508/103
See application file for complete search history.

(56) References Cited

U.S. PATENT DOCUMENTS

| | | | |
|---|---|---|---|
| 6,528,182 | B1 | 3/2003 | Bello et al. |
| 2004/0132628 | A1 | 7/2004 | Geke et al. |
| 2004/0255818 | A1 | 12/2004 | Pawloski |

FOREIGN PATENT DOCUMENTS

| | | | |
|---|---|---|---|
| DE | 10115696 | A1 | 10/2002 |
| DE | 699 06 555 | T2 | 3/2004 |
| DE | 102008016348 | A | 10/2009 |
| DE | 102008016348 | A1 | 10/2009 |
| GB | 166949 | A | 7/1921 |
| GB | 739313 | A | 10/1955 |
| SU | 1204283 | A | 1/1986 |

OTHER PUBLICATIONS

DIN EN 10130.
DIN EN 10346.
Database WPI; Week 198633; Thomson Scientific, London, GB; AN 1986-217980; XP002736455 & SU 1 204 283 A (BOLYCHEV V S) Jan. 15, 1986 (Jan. 15, 1986) abstract.
English version of DIN EN 10130, "Cold rolled low carbon steel flat products for cold forming—Technical delivery conditions", European Committee for Standardization, (Dec. 2006).
English version of DIN EN 10346, "Continuously hot-dip coated steel flat products—Technical delivery conditions", European Committee for Standardization, (Mar. 2009).
English abstract of DE102008016348.
English abstract of DE10007625.
Prof. Dr-Ing. Fritz Klocke et al.: "Fertigungsverfahren", Band 4 "Umformen", Kapitel 2.8 (Fabrication processes, vol. 4 "Forming", Chapter 2.8), 5th edition, 2006, Springer Verlag Berlin Heidelberg ISBN 13 978-3-540-23650-4 (pp. 129-185).

USE OF A SULPHATE, AND METHOD FOR PRODUCING A STEEL COMPONENT BY FORMING IN A FORMING MACHINE

CROSS REFERENCE TO RELATED APPLICATIONS

This application is a U.S. National Stage Entry of International Patent Application Serial Number PCT/EP2015/069018, filed Aug. 19, 2015, which claims priority to European Patent Application No. 14 184 415.9 filed Sep. 11, 2014, the entire contents of which are incorporated herein by reference.

FIELD

The present disclosure generally relates to sulfates from a group including aluminum sulfate, ammonium sulfate, iron sulfate, and magnesium sulfate, as well as methods for producing components by forming flat steel products in forming machines.

BACKGROUND

For the forming to give a component, the respective flat steel product to be formed is inserted into a forming machine and then is formed by the machine to give the respective component. This forming may be implemented as cold forming, in other words as forming at temperatures below the recrystallization temperature of the respective steel of the flat steel products, or as hot forming, in other words as forming at operating temperatures which lie above the recrystallization temperature.

One typical example of a forming operation of this kind is deep drawing, in which the flat steel product to be formed is pressed by means of a punch into a die. The shape of die and punch here determine the form which the flat steel product receives as a result of the forming operation.

In any forming operation, there are relative movements between the product to be formed and the forming tool used for shaping in each case. At the same time there is contact between the surfaces of the product and the corresponding surfaces of the forming tool. The tribological system which develops between the tool and the product to be formed is determined by the physical properties of the product to be formed and of the tool, and also by the media present between the product to be formed and the tool. As a result of the relative movement between the forming tool and the product to be formed that makes contact with the forming tool, friction is produced.

In the forming of flat steel products, in particular, this friction may greatly differ locally, because, in the course of forming, the material of the flat steel product is deformed differently in sections and therefore the material of the flat steel product also flows to different extents locally during the deformation. Therefore, especially in the production of components of complex shape by deep drawing or comparable cold forming operations, where generally high degrees of forming are obtained and complex shapes are modeled, there are dynamically changing frictional conditions in which static friction and sliding friction may occur alternately.

The frictional forces which come about in the case of cold forming, in particular, may be high enough to possibly disrupt the continuous running of the shaping operation and to cause incorrect molding of the particular component being formed. At the same time, the unavoidable friction results in considerable tool wear.

Proving particularly critical in this respect are flat steel products to which a zinc-based or aluminum-based protective coating, affording protection from corrosion or other environmental influences, has been applied to the actual flat steel product.

In order to diminish the adverse effects triggered by friction during forming, the surfaces that come into contact with one another during the forming operation are in practice lined with lubricants. Through the use of suitable coating materials it is possible to protect the forming tools and so to extend the tool lives substantially. For this purpose, the lubricant may be applied both to the flat steel product to be formed and to those surfaces of the tool that come into contact with the flat steel product.

Customarily used as lubricants for cold forming are lubricants based on mineral oil, to which various additives may be added in order to optimize their lubricity effect, such as sulfur-containing, phosphorus-containing or chlorine-containing adjuvants. A detailed elucidation of tribology within forming technology is found in section 2.8 of volume 4 "Umformen" [Forming] of the "Fertigungsverfahren" [Fabrication processes] compendium by Prof. Dr.-Ing. Fritz Klocke, Prof. em. Dr.-Ing. Dr. h.c. mult. Wilfried König, $5^{th}$ edn., 2006, Springer-Verlag Berlin Heidelberg.

Examples of coating materials for cold forming that are based on mineral oil or similar hydrocarbons are described in DE 101 15 696 A1. These coating materials include lubricants with a paraffinic or naphthenic basis, or ester oils with a plant or animal basis.

DE 10 2008 016 348 A1, furthermore, describes a low-friction coating which is intended for application to the particular flat steel product to be formed and which is based on graphite in mineral oil. At high processing temperatures, this low-friction coating is said to ensure effective sliding of the metal between the processing tools.

DE 100 07 625 A1 discloses coating materials based on carbonic esters. The coating materials comprise one or more components selected from the group of the monoesters and/or diesters of mono- or oligophosphoric acids, triglycerides, and fatty acid methyl esters. These components are intended to serve in particular as a substitute for mineral oil hydrocarbons or other petroleum distillates.

DE 699 06 555 T1, lastly, describes a method for applying a layer of zinc hydroxysulfate to galvanized steel sheet. The layer is applied in the form of a solution to the flat steel product, the pH of the solution being greater than or equal to 12 but less than 13. The solution is applied to the galvanized surface of the flat steel product by anodic polarization of the surface. The layer thus produced consists of zinc hydroxysulfate, also called "basic zinc sulfate".

DETAILED DESCRIPTION

Figure 1:
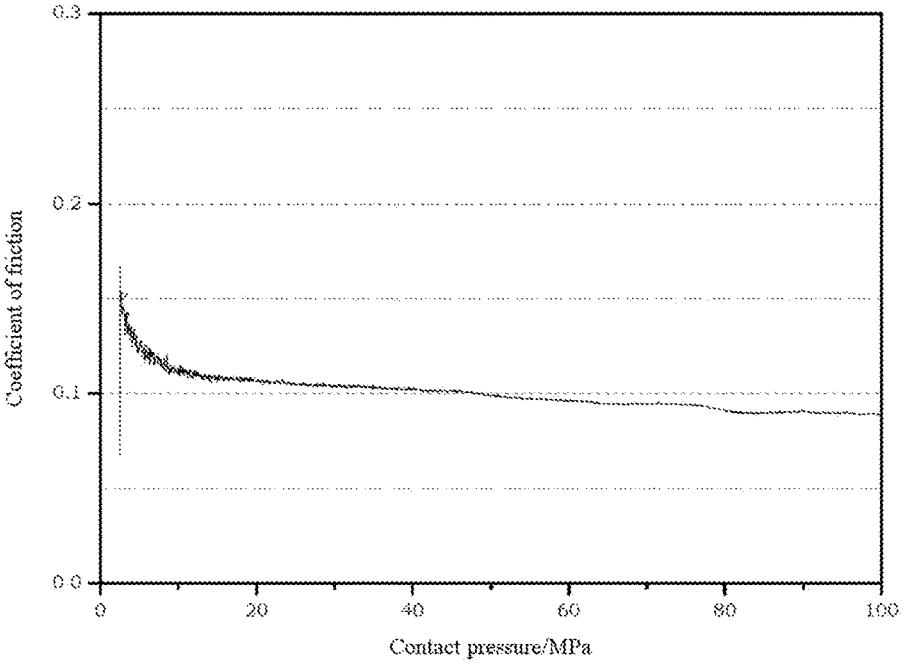
FIG. 1 is a diagram in which development of a coefficient of friction of a surface of a galvanized thin sheet coated with an ammonium sulfate layer, during a strip-drawing test, is plotted against a respective contact pressure.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Against the background of the prior art, the object of the invention was to identify coating materials which, with minimized lubricant demand on the one hand, permit optimized tribological conditions in the forming of flat steel products, and, on the other hand, are unobjectionable in terms of their effect on the environment.

The intention was also to specify a method with which components can be manufactured from flat steel products by cold forming with high efficiency and minimized environmental burden.

In relation to the coating material, this object, amongst others, has been achieved by employing a sulfate selected from the group consisting of aluminum sulfate, ammonium sulfate, iron sulfate, and magnesium sulfate as a coating material for improving the tribological characteristics of a flat steel product on forming in a forming machine.

The achievement by the present disclosure of the example object identified above in relation to the method lies in performing some of the worksteps specified herein in the production of a steel component.

Advantageous embodiments of the invention are specified in the dependent claims and are elucidated in detail below along with the general concept of the invention.

According to the understanding of the invention, the term "flat steel product" covers all rolled products whose length is very much greater than their thickness. They include steel strips and sheets and also blanks and billets obtained from them.

The flat steel products for cold forming in accordance with the invention encompass, in particular, what are called thin sheets, these being sheets having a thickness of less than 4 mm, more particularly 0.4-3.5 mm, typically 0.5-3 mm, which can be formed in the cold-rolled or hot-rolled state to give a component. An overview of flat steel products of the type in question, envisaged typically as thin sheets for cold forming, is provided by DIN EN 10130 (uncoated thin sheets) and by DIN EN 10346 (thin sheets provided with an anticorrosion coating). Examples here include the soft steels for forming with the material numbers 1.0226, 1.0350, 1.0355, 1.0306, 1.0322, 1.0853.

Surprisingly it has emerged that the sulfates envisaged in accordance with the invention as coating materials for flat steel products lead to a significant improvement in the tribological conditions during forming of flat steel products. Thus, with the sulfates selected in accordance with the invention for use as coating materials, it is possible to attain lubricating properties which match the properties achieved with conventional lubricants of the type presented at the outset. This effect is in principle independent of whether the forming is carried out as cold or hot forming. The sulfates used in accordance with the invention as coating materials prove particularly effective in the cold forming of flat steel products.

At the same time, the sulfates used in accordance with the invention as a coating material for improving the frictional conditions during forming are notable for high environmental compatibility and can be applied easily to the flat steel product in question.

On account of their solubility in water, the sulfates used in accordance with the invention can also be removed again easily, after deformation, from the steel components obtained after the forming operation in each case. Residues of coating remaining on the steel component cause at most insignificant interference to the operations customarily traversed, after forming, in the ongoing processing of steel components.

Specific sulfate coating materials particularly suitable in accordance with the invention for practical use are the sulfates from the group consisting of aluminum(III) sulfate, ammonium sulfate, iron(II) sulfate, iron(III) sulfate, and magnesium sulfate.

Ultimately, with the use as proposed in accordance with the invention of sulfates from the group consisting of aluminum sulfate, ammonium sulfate, iron sulfate, and magnesium sulfate, a coating material is available which has optimum processing properties and service properties and which can be provided readily in sufficient quantity at low cost.

The method of the invention for producing a steel component by forming a flat steel product in a forming machine comprises, accordingly, the following worksteps:

- providing the flat steel product,
- producing a tribologically active layer on at least one of the surfaces of the flat steel product or of the forming machine used for forming that come into mutual contact during forming, by coating with a coating material from the group consisting of aluminum sulfate, ammonium sulfate, iron sulfate, and magnesium sulfate;
- inserting the flat steel product into the forming tool;
- forming the flat steel product inserted into the forming machine, to give the component.

On account of their ease of application, the sulfates envisaged in accordance with the invention for use as coating materials in a method of the type of the invention are suitable for coating the surfaces of the respective tool with which the flat steel product to be formed comes into contact on forming. Hence the sulfates used in accordance with the invention may be applied as an aqueous solution to the critical surfaces of the forming tool by spraying, brushing or in another manner already known in practice for these purposes.

In the industrial application of the invention, it is found particularly advantageous if the flat steel product in question is coated with the coating material in the course of its production. In that case the ease of application and the ready adhesion of the sulfates used in accordance with the invention to the surface of the flat steel product that is to be coated are particularly beneficial. The sulfates proposed in accordance with the invention for use as lubricants can also be applied to the particular flat steel product to be formed, using conventional coating equipment of the kind customarily available for applying organic or inorganic layers to flat steel products of the type in question here. The respective sulfate as coating material can be applied to the flat steel product accordingly by dipping, spraying, coating, or brushing in.

The application of the sulfates used in accordance with the invention as coating materials for improving the frictional state during deformation of flat steel products is made particularly easy by the fact that these sulfates readily wet the particular surface to be coated and, accordingly, form uniform layers without any need for special measures. In particular there is no requirement for the respective aqueous solution to undergo particular heating. Instead, the aqueous solution comprising the sulfate intended for use in accordance with the invention can be applied at room temperature.

Application of the sulfates used as coating materials in accordance with the invention is particularly easy when they are applied in the form of an aqueous solution. After a subsequent drying operation, the flat steel product bears a dense, uniformly distributed, thin sulfate layer, which ensures optimum deformation characteristics during a forming operation, particularly a cold forming operation.

In this context it is found that there is no need for additives, of the kind required in the prior art in order, for example, to set a particular pH, to ensure effective coverage of the particular surface to be coated in the particular coating operation with the coating material used in accordance with the invention. Hence it has proven sufficient for the aqueous solution to consist of two components, of which one component is water as solvent and the other component is the respective sulfate as tribologically active constituent. If distilled water is used as solvent here, this has the advantage that there can be no disruption to the function of the coating by extraneous ions.

A sufficiently thick and dense tribologically active coating for the purposes of the invention on the surfaces of flat steel products or forming tools to be coated in each case is obtained if the amount of the tribologically active sulfate constituent in the aqueous solution is 0.2-1 mol/l (based on the $SO_4^2$-ion concentration), with highly effective coatings being produced in an operationally reliable way in practice when the amount of the sulfate constituent provided in accordance with the invention in the aqueous solution is 0.4-0.7 mol/l (based on the $SO_4^2$-ion concentration).

Mixtures of the sulfates provided as coating materials in accordance with the invention can also be applied inventively to the flat steel product.

In order to ensure reliable effect under the plant conditions for the sulfate coating material provided for use in accordance with the invention, the layer formed from the respective coating material on the flat steel product or on the surface of the forming tool to be coated can be applied with a coatweight of 5-50 mg/m$^2$. Optimum effects come about when the coatweight is 10-30 mg/m$^2$.

In order to ensure optimum adhesion on the respective surface of the coating material intended for use in accordance with the invention, the relevant surface can be subjected to alkaline cleaning before the coating material is applied.

The application of the sulfates provided in accordance with the invention for improving the tribological properties significantly enhances the coefficient of friction of the respectively coated surface. For instance, by a layer formed from the sulfates provided for use in accordance with the invention, the coefficient of friction of the respectively coated surface is regularly reduced to ≤0.15.

This success comes about especially when the flat steel product has been corrosion-protected by coating, in particular by hot dip coating, with a protective coating based on zinc. This Zn-based coating may have been applied conventionally to the respective steel substrate, as a pure zinc layer, as a zinc alloy layer with fractions of Mg, Al or Si, electrolytically, for example, or by hot dip coating. It is also possible for flat steel products to be coated inventively with Al-based coatings in order to improve their forming characteristics on cold or hot forming.

Without having for this purpose to accept the disadvantages of the conventional materials, such as potentially environmentally harmful constituents, complex methods of application and the like, coatings which are formed by the inventively selected coating materials thus achieve frictional properties which correspond reliably to the frictional properties of coatings which consist of conventional materials customarily used for improving the tribological properties.

The coefficient of friction profiles reproduced in the figures were determined in a strip-drawing test, which is explained, for example, in section 2.8.7.4 of volume 4 of the 5$^{th}$ edition of the "Fertigungsverfahren 4" [Fabrication methods 4] compendium by Fritz Klocke and Wilfried König, Springer-Verlag Berlin Heidelberg, 2006 (ISBN-13 978-3-540-23650-4).

Experiment 1

A tribologically active ammonium sulfate layer was applied to a conventional flat steel product in the form of a thin sheet strip provided with a Zn coating.

This was done by preparing an aqueous solution where 90 g of ammonium sulfate ($(NH_4)_2SO_4$) were dissolved in 1 l of water (distilled), giving the aqueous solution an ammonium sulfate content of 90 g/l. The native pH of the resulting solution was 5.3.

The aqueous solution thus constituted was applied at room temperature to the thin sheet flat steel product, subjected beforehand to alkaline cleaning, by means of a "Chemcoater" which is customary in the industry.

A "Chemcoater" is a plant component which is used in the steel industry for applying chemical substances, for application in the form of an aqueous solution, to galvanized quality flat steel. Such coaters are used in particular for applying water-soluble media which serve to pretreat the respective flat steel product for a subsequent varnish or film coating or for improving the corrosion control. It allows different treatment chemicals to be applied via rollers to the particular flat steel product to be coated. The flat steel product furnished with the coating subsequently travels through an oven, in which the coating is dried.

The parameters set when applying the ammonium sulfate solution are reported in table 1.

In order to determine the development of the coefficient of friction against the contact pressing, which is decisive for the characteristics on cold forming (deep drawing) in the cold-forming tool (punch/die) of a cold forming machine, samples of the resulting flat steel product, coated with the ammonium sulfate layer and additionally oiled with a conventional oil, which was a conventional, barium-free, thixotropic anticorrosion agent with good forming properties, available under the name PL 3802-39S, the oiling taking place with an add-on weight of 1.5 g/m$^2$, were subjected to a strip-drawing test. In this test, the samples were disposed at room temperature between two uncoated braking jaws consisting of the steel with material number 1.2379, which acted with a contact pressure of up to 100 MPa against the samples. The measuring distance was 500 mm/min at a testing speed of 60 mm/min. The contact area between tool and sample surface was 600 $m^2$. The result of this test is shown in FIG. 1.

Figure 2:
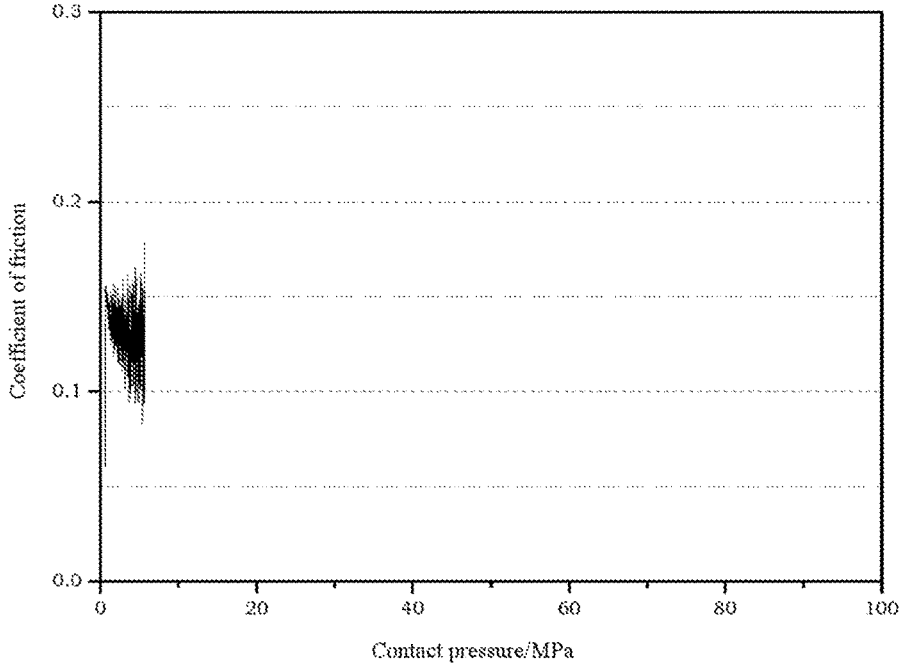
FIG. 2 is a diagram in which development of a coefficient of a surface of friction of an untreated galvanized thin sheet, during a strip-drawing test, is plotted against a respective contact pressure.

For comparison, an untreated sample of the same flat steel product was likewise subjected to a strip-drawing test under the same conditions as the sample investigated before. The profile of the coefficient of friction against the contact pressure, determined in this case, is reported in FIG. 2. The profile reproduced there shows that the substrate surface of the untreated sample exhibits the "slip-stick" effect already at a very early stage. The plot shown in FIG. 2 runs out, since the experiment was discontinued in order to avoid damage to the tool. This slip-stick effect is a phenomenon which occurs when the static friction is greater than the sliding friction. In this case, surface parts coupled in a damped manner perform a very rapid sequence of sticking, bracing, separating, and gliding. The effect disappears as soon as the friction partners are separated by a lubricant. The sulfates selected in accordance with the invention prove particularly effective here, as demonstrated by a comparison of FIG. 2 with FIG. 1 or with FIGS. 3 and 4, which are elucidated below.

Experiment 2

A tribologically active iron(II) sulfate layer is applied to a conventional flat steel product likewise in the form of a thin sheet strip provided with a Zn coating.

For this purpose, 189 g of iron(II) sulfate ($FeSO_4$) were dissolved in 1 l of fully demineralized water, giving the aqueous solution an iron sulfate content of 189 g/l. The native pH of the resulting solution was 2.2.

As in the case of experiment 1, the aqueous solution was applied at room temperature, using the coater already described above, to the flat steel product, which had undergone alkaline cleaning beforehand. The application parameters are again reported in table 1.

Figure 3:
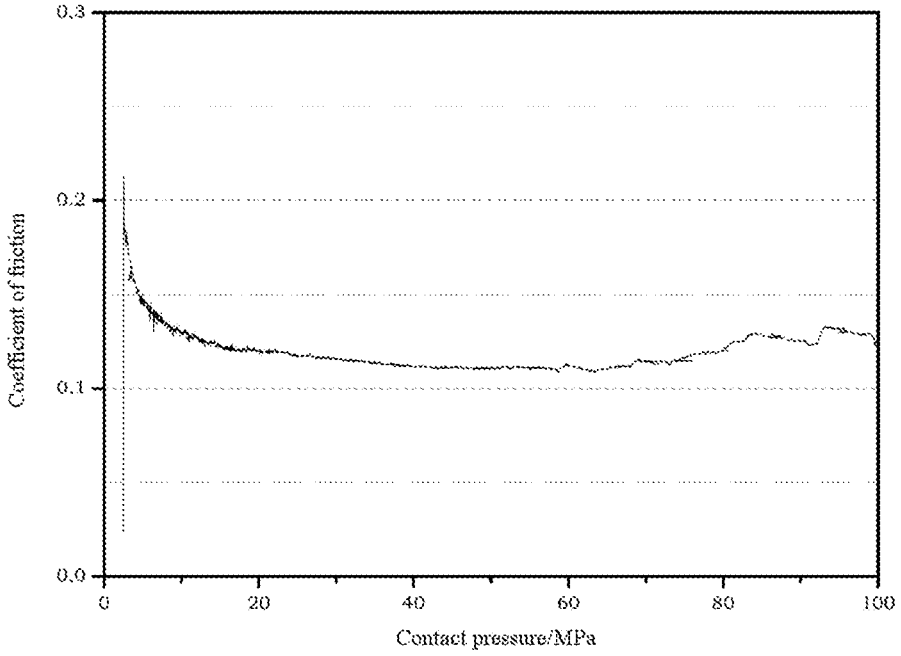
FIG. 3 is a diagram in which development of a coefficient of friction of a surface of a galvanized thin sheet coated with an iron(II) sulfate layer, during a strip-drawing test, is plotted against a respective contact pressure.

Samples of the flat steel product furnished with the layer of iron(II) sulfate were likewise subjected to a strip-drawing test under the conditions already elucidated above. The result of this test is shown in FIG. 3. It is apparent that, just like the ammonium sulfate layer investigated in experiment 1, the iron(II) sulfate layer reliably achieves coefficients of friction of less than 0.15 with relatively high contact pressures.

Experiment 3

A tribologically active aluminum sulfate layer is applied to a conventional flat steel product likewise in the form of a thin sheet strip provided with a Zn coating.

For this purpose, 240 g of aluminum sulfate ($Al_2(SO_4)_3$) were dissolved in 1 l of fully demineralized water, giving the aqueous solution an aluminum sulfate content of 240 g/l. The native pH of the resulting solution was 2.1.

In this case as well, the aqueous solution was applied at room temperature, using the coater already described above, to the flat steel product, which had undergone alkaline cleaning beforehand. The application parameters are again reported in table 1. In the table, the indication "Setting of dip roll and application roll" identifies the degree by which the squeeze-off gap present between the dip roll and application roll is smaller than the thickness of the processed flat steel product. At the same time, "PMT" refers to the "Peak Metal Temperature".

Figure 4:
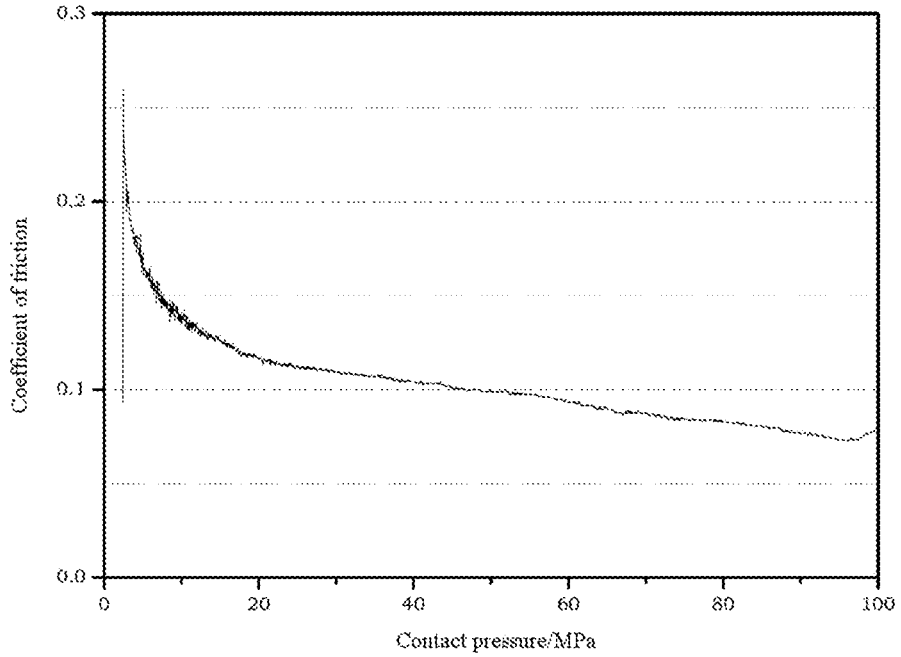
FIG. 4 is a diagram in which development of a coefficient of friction of a surface of a galvanized thin sheet coated with an aluminum sulfate layer, during a strip-drawing test, is plotted against a respective contact pressure.

Samples of the resulting flat steel product coated with the aluminum sulfate layer were again subjected to a strip-drawing test. The result of this test is shown in FIG. 4. Here as well it was confirmed that, just as for the ammonium sulfate layer investigated in experiment 1 and the iron(II) layer investigated in experiment 2, the aluminum sulfate layer reliably achieves coefficients of friction of less than 0.15 at relatively high contact pressures.

The tribologically active layers which consist of the sulfates proposed for use in accordance with the invention therefore achieve the same effect as the conventional coatings consisting, for example, of $ZnSO_4$.

TABLE 1

| | | Peripheral speeds | | | Setting of dip roll and | Thickness | Gap width between dip roll and | | Drying oven | | |
|---|---|---|---|---|---|---|---|---|---|---|---|
| Experiment | Mode of operation of coater | Application roll [m/min] | Dip roll [m/min] | Transport roll [m/min] | application roll [μm] | of flat steel product [mm] | application roll [μm] | Add-on weight [mg/$m^2$] | Temperature [° C.] | Residence time [s] | PMT [° C.] |
| 1 | reverse | 30 | 10 | 25 | −400 | 1 | 0.9 | 30 | 100 | 100 | 71 |
| 2 | reverse | 25 | 10 | 23 | −500 | 1 | 0.9 | 30 | 100 | 100 | 71 |
| 3 | co-rotating | 30 | 10 | 40 | −400 | 1 | 0.9 | 30 | 100 | 35 | 71 |

What is claimed is:

1. A flat steel product configured to be formed by a forming machine, the flat steel product comprising a coating material, the coating material consisting of:

water as a solvent; and a sulfate selected from a group consisting of aluminum sulfate, ammonium sulfate, iron sulfate, and magnesium sulfate;

wherein the coating material improves a tribological characteristic of the flat steel product relative to a tribological characteristic of a flat steel product without the coating material.

2. The flat steel product of claim 1 wherein the group consists of aluminum(III) sulfate, ammonium sulfate, iron (III) sulfate, iron(II) sulfate, and magnesium sulfate.

3. The flat steel product of claim 1 wherein the coating material forms a water-soluble layer.

4. A forming machine for forming a flat steel product, the forming machine comprising a coating material, the coating material consisting of:

water, as a solvent; and a sulfate selected from a group consisting of aluminum sulfate, ammonium sulfate, iron sulfate, and magnesium sulfate wherein the coating material improves a tribological characteristic of the forming machine relative to a tribological characteristic of a forming machine without the coating material.

5. The forming machine of claim 4 wherein the group consists of aluminum(III) sulfate, ammonium sulfate, iron (III) sulfate, iron(II) sulfate, and magnesium sulfate.

6. The forming machine of claim 4 wherein the coating material forms a water-soluble layer.

7. A method of producing a steel component by forming a flat steel product in a forming machine, the method comprising:

providing the flat steel product;

producing a tribologically-active layer on at least one surface of the flat steel product or of the forming machine by coating the at least one surface with a coating material consisting of water, as a solvent; and a sulfate selected from a group consisting of aluminum sulfate, ammonium sulfate, iron sulfate, and magnesium sulfate;

inserting the flat steel product into the forming tool; and forming the flat steel product to create the steel component, wherein during forming the at least one surface of the flat steel product comes into contact with the forming machine, or the at least one surface of the forming machine comes into contact with the flat steel product.

8. The method of claim 7 wherein the group consists of aluminum(III) sulfate, ammonium sulfate, iron(II) sulfate, iron(III) sulfate, and magnesium sulfate.

9. The method of claim 7 wherein the forming of the flat steel product is performed as cold forming of the flat steel product.

10. The method of claim 7 wherein the tribologically-active layer is produced on the flat steel product.

11. The method of claim 10 wherein the tribologically-active layer produced on the flat steel product is applied with a coatweight of 5-50 $mg/m^2$.

12. The method of claim 10 wherein a coefficient of friction of the at least one surface of the flat steel product after the tribologically-active layer is produced is not more than 0.15.

13. The method of claim 7 wherein the first component is distilled water as the solvent.

14. The method of claim 7 wherein an amount of the tribologically-active constituent in the aqueous solution is 0.2-1 mol/l based on a $SO_4^{2-}$ ion concentration.

15. The method of claim 7 wherein the flat steel product includes a anticorrosion control coat, wherein the tribologically-active layer is produced on the anticorrosion control coat.

* * * * *